US009552822B2

(12) United States Patent
Multrus et al.

(10) Patent No.: US 9,552,822 B2
(45) Date of Patent: Jan. 24, 2017

(54) APPARATUS AND METHOD FOR PROCESSING AN AUDIO SIGNAL AND FOR PROVIDING A HIGHER TEMPORAL GRANULARITY FOR A COMBINED UNIFIED SPEECH AND AUDIO CODEC (USAC)

(71) Applicants: Fraunhofer-Gesellschaft zur Foerderung der angewandten Forschung e.V., Munich (DE); VoiceAge Corporation, Montreal, Quebec (CA)

(72) Inventors: Markus Multrus, Nuremberg (DE); Bernhard Grill, Lauf (DE); Nikolaus Rettelbach, Nuremberg (DE); Guillaume Fuchs, Erlangen (DE); Max Neuendorf, Nuremberg (DE); Bruno Bessette, Sherbrooke (CA); Roch Lefebvre, Magog (CA); Philippe Gournay, Sherbrooke (CA); Stephan Wilde, Nuremberg (DE)

(73) Assignees: Fraunhofer-Gesellschaft zur Foerderung der angewandten Forschung e.V., Munich (DE); VoiceAge Corporation, Quebec (CA)

( * ) Notice: Subject to any disclaimer, the term of this patent is extended or adjusted under 35 U.S.C. 154(b) by 615 days.

(21) Appl. No.: 13/855,889

(22) Filed: Apr. 3, 2013

(65) Prior Publication Data

US 2013/0226570 A1 Aug. 29, 2013

Related U.S. Application Data

(63) Continuation of application No. PCT/EP2011/067318, filed on Oct. 4, 2011.

(Continued)

(51) Int. Cl.
*G10L 19/12* (2013.01)
*G10L 19/02* (2013.01)

(Continued)

(52) U.S. Cl.
CPC ..... *G10L 19/12* (2013.01); *G10L 19/0204* (2013.01); *G10L 21/00* (2013.01); *G10L 2019/0012* (2013.01)

(58) Field of Classification Search
CPC ..... G10L 19/12; G10L 21/00; G10L 19/265; G10L 19/26
See application file for complete search history.

(56) References Cited

U.S. PATENT DOCUMENTS 5,673,363 A 9/1997 Jeon et al.
6,006,108 A * 12/1999 Black et al. ..... 455/553.1

(Continued)

FOREIGN PATENT DOCUMENTS

CN 101218630 A 7/2008
EP 1 204 095 A1 5/2002

(Continued)

OTHER PUBLICATIONS

Neuendorf, Max, et al. "A novel scheme for low bitrate unified speech and audio coding-MPEG RMO." Audio Engineering Society Convention 126. Audio Engineering Society, 2009.*

(Continued)

*Primary Examiner* — Matthew Baker
(74) *Attorney, Agent, or Firm* — Keating & Bennett, LLP

(57) ABSTRACT

An apparatus for processing an audio signal is provided. The apparatus has a signal processor and a configurator. The configurator is adapted to configure the signal processor based on configuration information such that a configurable upsampling factor is equal to a first upsampling value when a first ratio of the second configurable number of samples to (Continued)

a first configurable number of samples has a first ratio value. Moreover, the configurator is adapted to configure the signal processor such that the configurable upsampling factor is equal to a different second upsampling value, when a different second ratio of the second configurable number of samples to the first configurable number of samples has a different second ratio value. The first or the second ratio value is not an integer value.

17 Claims, 11 Drawing Sheets

Related U.S. Application Data

(60) Provisional application No. 61/390,267, filed on Oct. 6, 2010.

(51) Int. Cl.
*G10L 21/00* (2013.01)
*G10L 19/00* (2013.01)

(56) References Cited

U.S. PATENT DOCUMENTS

| | | | | |
|---|---|---|---|---|
| 6,108,626 | A | 8/2000 | Cellario et al. | |
| 6,208,276 | B1 * | 3/2001 | Snyder | 341/123 |
| 6,208,671 | B1 * | 3/2001 | Paulos et al. | 370/545 |
| 6,275,836 | B1 * | 8/2001 | Lu | 708/313 |
| 6,384,759 | B2 * | 5/2002 | Snyder | 341/123 |
| 6,629,078 | B1 * | 9/2003 | Grill et al. | 704/500 |
| 6,750,793 | B2 * | 6/2004 | Takeda | 341/126 |
| 7,177,812 | B1 * | 2/2007 | Absar et al. | 704/265 |
| 7,610,195 | B2 * | 10/2009 | Ojanpera | 704/200.1 |
| 8,484,038 | B2 * | 7/2013 | Bessette et al. | 704/500 |
| 2001/0005173 | A1 * | 6/2001 | Snyder | G10L 19/0212 341/123 |
| 2003/0009325 | A1 * | 1/2003 | Kirchherr et al. | 704/211 |
| 2006/0100859 | A1 | 5/2006 | Jelinek et al. | |
| 2006/0195314 | A1 * | 8/2006 | Taleb et al. | 704/200.1 |
| 2006/0273938 | A1 * | 12/2006 | Van Den Enden et al. | 341/61 |
| 2007/0010996 | A1 | 1/2007 | Liebchen | |
| 2007/0192390 | A1 | 8/2007 | Wang et al. | |
| 2007/0206690 | A1 | 9/2007 | Sperschneider et al. | |
| 2008/0114605 | A1 * | 5/2008 | Wu et al. | 704/500 |
| 2008/0133227 | A1 * | 6/2008 | Kong et al. | 704/230 |
| 2010/0153122 | A1 * | 6/2010 | Wang et al. | 704/501 |
| 2011/0004479 | A1 * | 1/2011 | Ekstrand et al. | 704/500 |
| 2011/0087494 | A1 * | 4/2011 | Kim et al. | 704/500 |
| 2011/0202337 | A1 | 8/2011 | Fuchs et al. | |
| 2011/0238425 | A1 * | 9/2011 | Neuendorf et al. | 704/500 |
| 2011/0257984 | A1 * | 10/2011 | Virette et al. | 704/503 |
| 2011/0320196 | A1 * | 12/2011 | Choo et al. | 704/229 |
| 2012/0209600 | A1 * | 8/2012 | Kim et al. | 704/219 |
| 2013/0226570 | A1 * | 8/2013 | Multrus et al. | 704/219 |
| 2013/0282917 | A1 * | 10/2013 | Reznik et al. | 709/231 |
| 2014/0019146 | A1 * | 1/2014 | Neuendorf et al. | 704/500 |

FOREIGN PATENT DOCUMENTS

| | | | |
|---|---|---|---|
| JP | 3-286698 | A | 11/1996 |
| JP | 10-512423 | A | 11/1998 |
| JP | 2005-532579 | A | 10/2005 |
| JP | 2007-47813 | A | 2/2007 |
| JP | 2009-527206 | A | 7/2009 |
| RU | 2 355 046 | C2 | 10/2008 |
| WO | 2005/098823 | A2 | 10/2005 |
| WO | 2010/003521 | A1 | 1/2010 |
| WO | 2010/003539 | A1 | 1/2010 |

OTHER PUBLICATIONS

European Broadcasting Union, Specification of the Digital Audio Interface (The AES/EBU interface) Tech 3250-E third edition (2004).*

Official Communication issued in International Patent Application No. PCT/EP2011/067318, mailed on Jan. 12, 2012.

Official Communication issued in corresponding Russian Patent Application No. 2013120320, mailed on Mar. 18, 2015.

Official Communication issued in corresponding Japanese Patent Application No. 2013-532172, mailed on Mar. 24, 2016.

* cited by examiner

APPARATUS AND METHOD FOR PROCESSING AN AUDIO SIGNAL AND FOR PROVIDING A HIGHER TEMPORAL GRANULARITY FOR A COMBINED UNIFIED SPEECH AND AUDIO CODEC (USAC)

CROSS-REFERENCE TO RELATED APPLICATIONS

This application is a continuation of copending International Application No. PCT/EP2011/067318, filed Oct. 4, 2011, which is incorporated herein by reference in its entirety, and additionally claims priority from U.S. Application No. 61/390,267, filed Oct. 6, 2010, which is also incorporated herein by reference in its entirety.

BACKGROUND OF THE INVENTION

The present invention relates to audio processing and, in particular to an apparatus and method for processing an audio signal and for providing a higher temporal granularity for a Combined Unified Speech and Audio Codec (USAC).

USAC, as other audio codecs, exhibits a fixed frame size (USAC: 2048 samples/frame). Although there is the possibility to switch to a limited set of shorter transform sizes within one frame, the frame size still limits the temporal resolution of the complete system. To increase the temporal granularity of the complete system, for traditional audio codecs the sampling rate is increased, leader to a shorter duration of one frame in time (e.g. milliseconds). However, this is not easily possible for the USAC codec:

The USAC codec comprises a combination of tools from traditional general audio codecs, such as AAC (Advanced Audio Coding) transform coder, SBR (Spectral Band Replication) and MPEG Surround (MPEG=Moving Picture Experts Group), plus tools from traditional speech coders, such as ACELP (ACELP=Algebraic Code Excited Linear Prediction). Both, ACELP and transform coder, run usually at the same time within the same environment (i.e. frame size, sampling rate), and can be easily switched: usually, for clean speech signals, the ACELP tool is used, and for music, mixed signals the transform coder is used.

The ACELP tool is at the same time limited to work only at comparably low sampling rates. For 24 kbit/s, a sampling rate of only 17075 Hz is used. For higher sampling rates, the ACELP tool starts to drop significantly in performance. The transform coder as well as SBR and MPEG Surround however would benefit from a much higher sampling rate, for example 22050 Hz for the transform coder and 44100 Hz for SBR and MPEG Surround. So far, however, the ACELP tool limited the sampling rate of the complete system, leading to a suboptimal system in particular for music signals.

SUMMARY

According to an embodiment, an apparatus for processing an audio signal may have: a signal processor being adapted to receive a first audio signal frame having a first configurable number of samples of the audio signal, being adapted to upsample the audio signal by a configurable upsampling factor to obtain a processed audio signal, and being adapted to output a second audio signal frame having a second configurable number of samples of the processed audio signal; and a configurator being adapted to configure the signal processor, wherein the configurator is adapted to configure the signal processor based on configuration information such that the configurable upsampling factor is equal to a first upsampling value when a first ratio of the second configurable number of samples to the first configurable number of samples has a first ratio value, and wherein the configurator is adapted to configure the signal processor such that the configurable upsampling factor is equal to a different second upsampling value, when a different second ratio of the second configurable number of samples to the first configurable number of samples has a different second ratio value, and wherein the first or the second ratio value is not an integer value.

According to another embodiment, a method for processing an audio signal may have the steps of: configuring a configurable upsampling factor, receiving a first audio signal frame having a first configurable number of samples of the audio signal, and upsampling the audio signal by the configurable upsampling factor to obtain a processed audio signal, and being adapted to output a second audio frame having a second configurable number of samples of the processed audio signal; and wherein the configurable upsampling factor is configured based on configuration information such that the configurable upsampling factor is equal to a first upsampling value when a first ratio of the second configurable number of samples to the first configurable number of samples has a first ratio value, and wherein the configurable upsampling factor is configured such that the configurable upsampling factor is equal to a different second upsampling value, when a different second ratio of the second configurable number of samples to the first configurable number of samples has a different second ratio value, and wherein the first or the second ratio value is not an integer value.

According to another embodiment, an apparatus for processing an audio signal may have: a signal processor being adapted to receive a first audio signal frame having a first configurable number of samples of the audio signal, being adapted to downsample the audio signal by a configurable downsampling factor to obtain a processed audio signal, and being adapted to output a second audio frame having a second configurable number of samples of the processed audio signal; and a configurator being adapted to configure the signal processor, wherein the configurator is adapted to configure the signal processor based on configuration information such that the configurable downsampling factor is equal to a first downsampling value when a first ratio of the second configurable number of samples to the first configurable number of samples has a first ratio value, and wherein the configurator is adapted to configure the signal processor such that the configurable downsampling factor is equal to a different second downsampling value, when a different second ratio of the second configurable number of samples to the first configurable number of samples has a different second ratio value, and wherein the first or the second ratio value is not an integer value.

According to another embodiment, a method for processing an audio signal may have the steps of: configuring a configurable downsampling factor, receiving a first audio signal frame having a first configurable number of samples of the audio signal, and downsampling the audio signal by the configurable downsampling factor to obtain a processed audio signal, and being adapted to output a second audio frame having a second configurable number of samples of the processed audio signal; and wherein the configurable downsampling factor is configured based on configuration information such that the configurable downsampling factor is equal to a first downsampling value when a first ratio of the second configurable number of samples to the first configurable number of samples has a first ratio value, and wherein the configurable downsampling factor is configured such that the configurable downsampling factor is equal to a different second downsampling value, when a different second ratio of the second configurable number of samples to the first configurable number of samples has a different second ratio value, and wherein the first or the second ratio value is not an integer value.

Another embodiment may have a computer program for performing the above methods, when the computer program is executed by a computer or processor.

The current USAC RM provides high coding performance over a large number of operating points, ranging from very low bitrates such as 8 kbit/s up to transparent quality at bitrates of 128 kbit/s and above. To reach this high quality over such a broad range of bitrates, a combination of tools, such as MPEG Surround, SBR, ACELP and traditional transform coders are used. Such a combination of tools of course necessitates a joint optimization process of the tool interoperation and a common environment, where these tools are placed.

It was found in this joint optimization process that some of the tools have deficiencies reproducing signals, which expose a high temporal structure in the mid-bitrate range (24 kbit/s–32 kbit/s). In particular the tools MPEG Surround, SBR and the FD transform coders (FD, TCX) (FD=Frequency Domain; TCX=Transform Coded Excitation), i.e. all tools, which operate in the frequency domain, can perform better when operated with higher temporal granularity, which is identical to a shorter frame size in time domain.

Compared to state of the art HE-AACv2 encoder (High-Efficiency AAC v2 encoder) it was found that the current USAC reference quality encoder operates at bitrates such as 24 kbit/s and 32 kbit/s at a significantly lower sampling rate, while using the same frame size (in samples). This means the duration of the frames in milliseconds is significantly longer. To compensate for these deficiencies, the temporal granularity needs to be increased. This can be either reached by increasing the sampling frequency or shortening the frame sizes (e.g. of systems using a fixed frame size).

Whereas increasing the sampling frequency is a reasonable way forward for SBR and MPEG Surround to increase the performance for temporal dynamic signals, this will not work for all core-coder tools: It is well known that a higher sampling frequency would be beneficial to the transform coder, but at the same time drastically decreases the performance of the ACELP tool.

An apparatus for processing an audio signal is provided. The apparatus comprises a signal processor and a configurator. The signal processor is adapted to receive a first audio signal frame having a first configurable number of samples of the audio signal. Moreover, the signal processor is adapted to upsample the audio signal by a configurable upsampling factor to obtain a processed audio signal. Furthermore, the signal processor is adapted to output a second audio signal frame having a second configurable number of samples of the processed audio signal.

The configurator is adapted to configure the signal processor based on configuration information such that the configurable upsampling factor is equal to a first upsampling value when a first ratio of the second configurable number of samples to the first configurable number of samples has a first ratio value. Moreover, the configurator is adapted to configure the signal processor such that the configurable upsampling factor is equal to a different second upsampling value, when a different second ratio of the second configurable number of samples to the first configurable number of samples has a different second ratio value. The first or the second ratio value is not an integer value.

According to the above-described embodiment, a signal processor upsamples an audio signal to obtain a processed upsampled audio signal. In the above embodiment, the upsampling factor is configurable and can be a non-integer value. The configurability and the fact that the upsampling factor can be a non-integer value increases the flexibility of the apparatus. When a different second ratio of the second configurable number of samples to the first configurable number of samples has a different second ratio value, then the configurable upsampling factor has a different second upsampling value. Thus, the apparatus is adapted to take a relationship between the upsampling factor and the ratio of the frame length (i.e. the number of samples) of the second and the first audio signal frame into account.

In an embodiment, the configurator is adapted to configure the signal processor such that the different second upsampling value is greater than the first upsampling value, when the second ratio of the second configurable number of samples to the first configurable number of samples is greater than the first ratio of the second configurable number of samples to the first configurable number of samples.

According to an embodiment, a new operating mode (in the following called "extra setting") for the USAC codec is proposed, which enhances the performance of the system for mid-data rates, such as 24 kbit/s and 32 kbit/s. It was found that for these operating points, the temporal resolution of the current USAC reference codec is too low. It is therefore proposed to a) increase this temporal resolution by shortening the core-coder frame sizes without increasing the sampling rate for the core-coder, and further b) to increase the sampling rate for SBR and MPEG Surround without changing the frame size for these tools.

The proposed extra setting greatly improves the flexibility of the system, since it allows the system including the ACELP tool to be operated at higher sampling rates, such as 44.1 and 48 kHz. Since these sampling rates are typically requested in the marketplace, it is expected that this would help for the acceptance of the USAC codec.

The new operating mode for the current MPEG Unified Speech and Audio Coding (USAC) work item increases the temporal flexibility of the whole codec, by increasing the temporal granularity of the complete audio codec. If (assuming that the second number of samples remained the same) the second ratio is greater than the first ratio, then the first configurable number of samples has been reduced, i.e. the frame size of the first audio signal frame has been shortened. This results in a higher temporal granularity, and all tools which operate in the frequency domain and which process the first audio signal frame can perform better. In such a high efficient operating mode, however, it is also desirable to increase the performance of tools which process the second audio signal frame comprising the upsampled audio signal. Such an increase in performance of these tools can be realized by a higher sampling rate of the upsampled audio signal, i.e. by increasing the upsampling factor for such an operating mode. Moreover, tools exist, such as the ACELP decoder in USAC, which do not operate in the frequency domain, which process the first audio signal frame and which operate best when the sampling rate of the (original) audio signal is relatively low. These tools benefit from a high upsampling factor, as this means that the sampling rate of the (original) audio signal is relatively low compared to the sampling rate of the upsampled audio signal. The above described embodiment provides an apparatus adapted for providing a configuration mode for an efficient operation mode for such an environment.

The new operating mode increases the temporal flexibility of the whole codec, by increasing the temporal granularity of the complete audio codec.

In an embodiment, the configurator is adapted to configure the signal processor such that the configurable upsampling factor is equal to the first ratio value when the first ratio of the second configurable number of samples to the first configurable number of samples has the first ratio value, and wherein the configurator is adapted to configure the signal processor such that the configurable upsampling factor is equal to the different second ratio value when the second ratio of the second configurable number of samples to the first configurable number of samples has the different second ratio value.

In an embodiment, the configurator is adapted to configure the signal processor such that the configurable upsampling factor is equal to 2 when the first ratio has the first ratio value, and wherein the configurator is adapted to configure the signal processor such that the configurable upsampling factor is equal to 8/3 when the second ratio has the different second ratio value.

According to a further embodiment, the configurator is adapted to configure the signal processor such that the first configurable number of samples is equal to 1024 and the second configurable number of samples is equal to 2048 when the first ratio has the first ratio value, and wherein the configurator is adapted to configure the signal processor such that that the first configurable number of samples is equal to 768 and the second configurable number of samples is equal to 2048 when the second ratio has the different second ratio value.

In an embodiment, it is proposed to introduce an additional setting of the USAC coder, where the core-coder is operated at a shorter frame size (768 instead of 1024 samples). Furthermore, it is proposed to modify in this context the resampling inside the SBR decoder from 2:1 to 8:3, to allow SBR and MPEG Surround being operated at a higher sampling rate.

Furthermore, according to an embodiment, the temporal granularity of the core-coder is increased by shrinking the core-coder frame size from 1024 to 768 samples. By this step, the temporal granularity of the core coder is increased by 4/3 while leaving the sampling rate constant: This allows the ACELP to run at an appropriate sampling frequency (Fs).

Moreover, at the SBR tool, a resampling of ratio 8/3 (so far: ratio 2) is applied, converting a core-coder frame of size 768 at ⅜ Fs to a output frame of size 2048 at Fs. This allows the SBR tool and an MPEG Surround Tool to be run at a traditionally high sampling rate (e.g. 44100 Hz). Thus, good quality for speech and music signals is provided, as all tools are to be run in their optimal operating point.

In an embodiment, the signal processor comprises a core decoder module for decoding the audio signal to obtain a preprocessed audio signal, an analysis filter bank having a number of analysis filter bank channels for transforming the first preprocessed audio signal from a time domain into a frequency domain to obtain a frequency-domain preprocessed audio signal comprising a plurality of subband signals, a subband generator for creating and adding additional subband signals for the frequency-domain preprocessed audio signal, and a synthesis filter bank having a number of synthesis filter bank channels for transforming the first preprocessed audio signal from the frequency domain into the time domain to obtain the processed audio signal. The configurator may be adapted to configure the signal processor by configuring the number of synthesis filter bank channels or the number of analysis filter bank channels such that the configurable upsampling factor is equal to a third ratio of the number of synthesis filter bank channels to the number of analysis filter bank channels. The subband generator may be a Spectral Band Replicator being adapted to replicate subband signals of the preprocessed audio signal generator for creating the additional subband signals for the frequency-domain preprocessed audio signal. The signal processor may furthermore comprise an MPEG Surround decoder for decoding the preprocessed audio signal to obtain a preprocessed audio signal comprising stereo or surround channels. Moreover, the subband generator may be adapted to feed the frequency-domain preprocessed audio signal into the MPEG Surround decoder after the additional subband signals for the frequency-domain preprocessed audio signal have been created and added to the frequency-domain preprocessed audio signal.

The core decoder module may comprise a first core decoder and a second core decoder, wherein the first core decoder may be adapted to operate in a time domain and wherein the second core decoder may be adapted to operate in a frequency domain. The first core decoder may be an ACELP decoder and the second core decoder may be a FD transform decoder or a TCX transform decoder.

In an embodiment, the super-frame size for the ACELP codec is reduced from 1024 to 768 samples. This could be done by combining 4 ACELP frames of size 192 (3 sub-frames of size 64) to one core-coder frame of size 768 (previously: 4 ACELP frames of size 256 were combined to a core-coder frame of size 1024). Another solution for reaching a core-coder frame size of 768 samples would be for example to combine 3 ACELP frames of size 256 (4 sub-frames of size 64).

According to a further embodiment, the configurator is adapted to configure the signal processor based on the configuration information indicating at least one of the first configurable number of samples of the audio signal or the second configurable number of samples of the processed audio signal.

In another embodiment, the configurator is adapted to configure the signal processor based on the configuration information, wherein the configuration information indicates the first configurable number of samples of the audio signal and the second configurable number of samples of the processed audio signal, wherein the configuration information is a configuration index.

Moreover, an apparatus for processing an audio signal is provided. The apparatus comprises a signal processor and a configurator. The signal processor is adapted to receive a first audio signal frame having a first configurable number of samples of the audio signal. Moreover, the signal processor is adapted to downsample the audio signal by a configurable downsampling factor to obtain a processed audio signal. Furthermore, the signal processor is adapted to output a second audio signal frame having a second configurable number of samples of the processed audio signal.

The configurator may be adapted to configure the signal processor based on configuration information such that the configurable downsampling factor is equal to a first downsampling value when a first ratio of the second configurable number of samples to the first configurable number of samples has a first ratio value. Moreover, the configurator is adapted to configure the signal processor such that the configurable downsampling factor is equal to a different second downsampling value, when a different second ratio of the second configurable number of samples to the first configurable number of samples has a different second ratio value. The first or the second ratio value is not an integer value.

BRIEF DESCRIPTION OF THE DRAWINGS

Embodiments of the present invention are subsequently discussed with respect to the accompanying figures, in which.

DETAILED DESCRIPTION OF THE INVENTION

Figure 1:
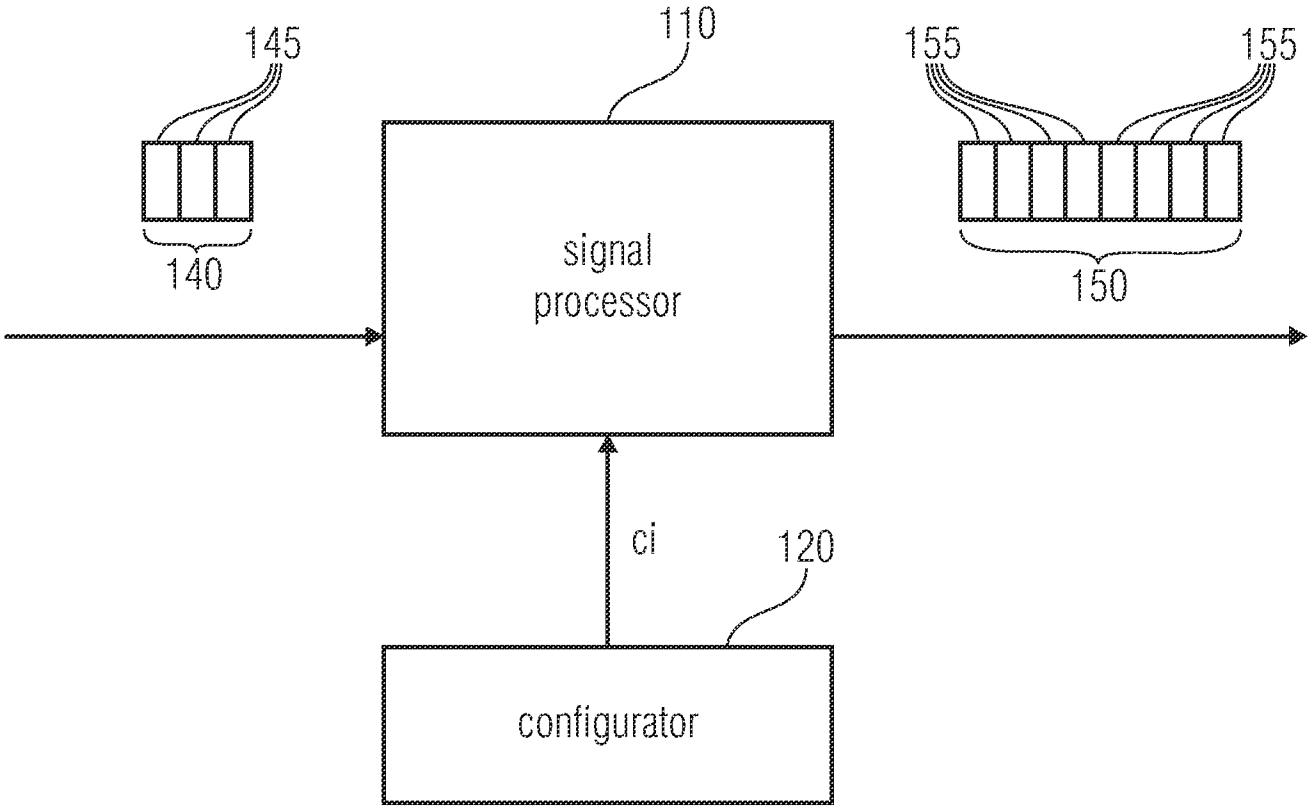
FIG. 1 illustrates an apparatus for processing an audio signal according to an embodiment.

FIG. 1 illustrates an apparatus for processing an audio signal according to an embodiment. The apparatus comprises a signal processor 110 and a configurator 120. The signal processor 110 is adapted to receive a first audio signal frame 140 having a first configurable number of samples 145 of the audio signal. Moreover, the signal processor 110 is adapted to upsample the audio signal by a configurable upsampling factor to obtain a processed audio signal. Furthermore, the signal processor is adapted to output a second audio signal frame 150 having a second configurable number of samples 155 of the processed audio signal.

The configurator 120 is adapted to configure the signal processor 110 based on configuration information ci such that the configurable upsampling factor is equal to a first upsampling value when a first ratio of the second configurable number of samples to the first configurable number of samples has a first ratio value. Moreover, the configurator 120 is adapted to configure the signal processor 110 such that the configurable upsampling factor is equal to a different second upsampling value, when a different second ratio of the second configurable number of samples to the first configurable number of samples has a different second ratio value. The first or the second ratio value is not an integer value.

An apparatus according to FIG. 1 may for example be employed in the process of decoding.

According to an embodiment, the configurator 120 may be adapted to configure the signal processor 110 such that the different second upsampling value is greater than the first different upsampling value, when the second ratio of the second configurable number of samples to the first configurable number of samples is greater than the first ratio of the second configurable number of samples to the first configurable number of samples. In a further embodiment, the configurator 120 is adapted to configure the signal processor 110 such that the configurable upsampling factor is equal to the first ratio value when the first ratio of the second configurable number of samples to the first configurable number of samples has the first ratio value, and wherein the configurator 120 is adapted to configure the signal processor 110 such that the configurable up sampling factor is equal to the different second ratio value when the second ratio of the second configurable number of samples to the first configurable number of samples has the different second ratio value.

In another embodiment, the configurator 120 is adapted to configure the signal processor 110 such that the configurable upsampling factor is equal to 2 when the first ratio has the first ratio value, and wherein the configurator 120 is adapted to configure the signal processor 110 such that the configurable upsampling factor is equal to 8/3 when the second ratio has the different second ratio value. According to a further embodiment, the configurator 120 is adapted to configure the signal processor 110 such that the first configurable number of samples is equal to 1024 and the second configurable number of samples is equal to 2048 when the first ratio has the first ratio value, and wherein the configurator 120 is adapted to configure the signal processor 110 such that that the first configurable number of samples is equal to 768 and the second configurable number of samples is equal to 2048 when the second ratio has the different second ratio value.

In an embodiment, the configurator 120 is adapted to configure the signal processor 110 based on the configuration information ci, wherein the configuration information ci indicates the upsampling factor, the first configurable number of samples of the audio signal and the second configurable number of samples of the processed audio signal, wherein the configuration information is a configuration index.

The following table illustrates an example for a configuration index as configuration information:

| Index | coreCoderFrameLength | sbrRatio | outputFrameLength |
|---|---|---|---|
| 2 | 768 | 8:3 | 2048 |
| 3 | 1024 | 2:1 | 2048 |

wherein "Index" indicates the configuration index, wherein "coreCoderFrameLength" indicates the first configurable number of samples of the audio signal, wherein "sbrRatio" indicates the upsampling factor and wherein "outputFrameLength" indicates the second configurable number of samples of the processed audio signal.

Figure 2:
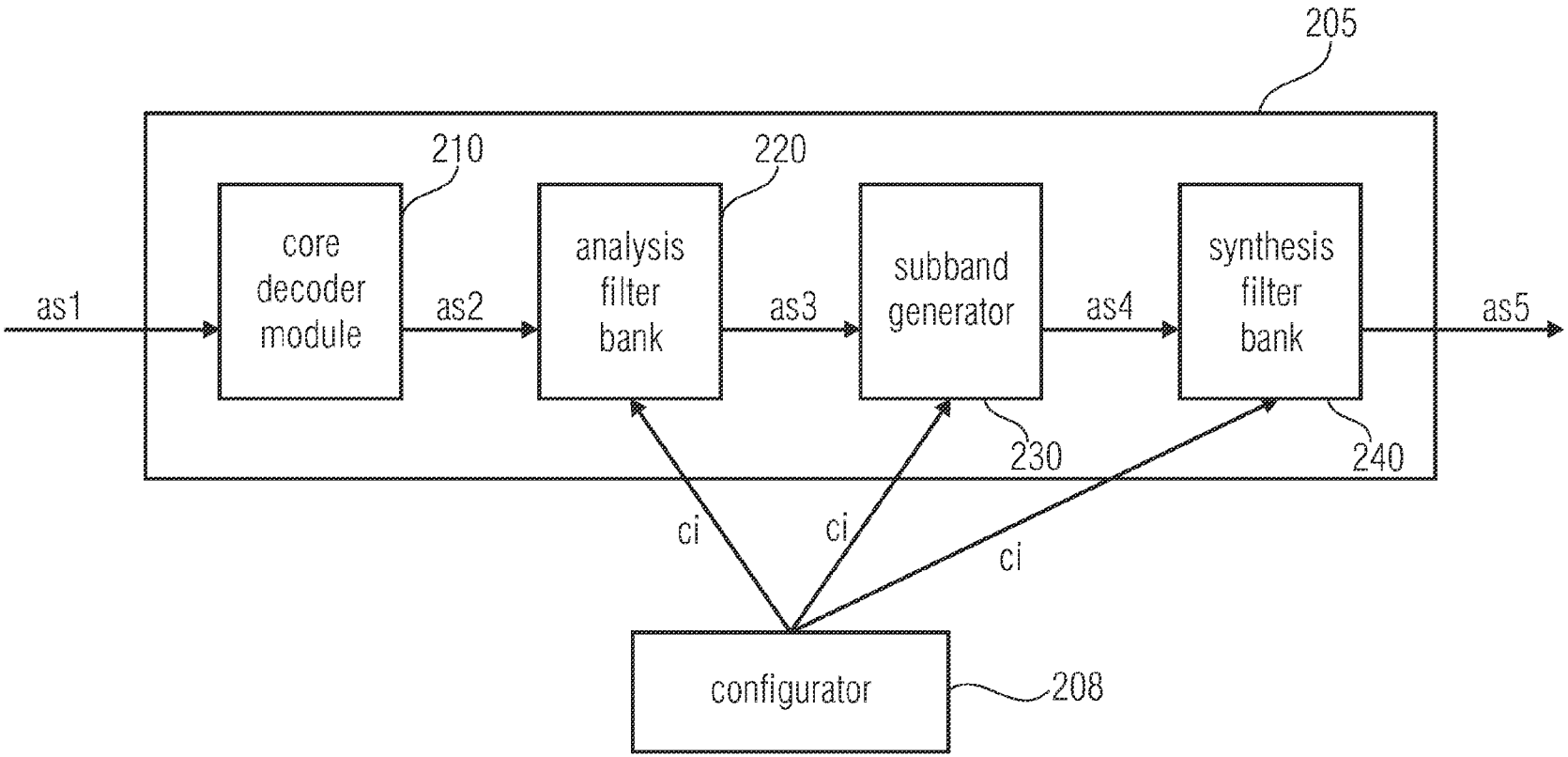
FIG. 2 illustrates an apparatus for processing an audio signal according to another embodiment.

FIG. 2 illustrates an apparatus according to another embodiment. The apparatus comprises a signal processor 205 and a configurator 208. The signal processor 205 comprises a core decoder module 210, an analysis filter bank 220, a subband generator 230 and a synthesis filter bank 240.

The core decoder module 210 is adapted to receive an audio signal as1. After receiving the audio signal as1, the core decoder module 210 decodes the audio signal to obtain a preprocessed audio signal as2. Then, the core decoder module 210 feeds the preprocessed audio signal as2, being represented in a time domain, into the analysis filter bank 220.

The analysis filter bank 220 is adapted to transform the preprocessed audio signal as2 from a time domain into a frequency domain to obtain a frequency-domain preprocessed audio signal as3 comprising a plurality of subband signals. The analysis filter bank 220 has a configurable number of analysis filter bank channels (analysis filter bank bands). The number of analysis filter bank channels determines the number of subband signals that are generated from the time-domain preprocessed audio signal as2. In an embodiment, the number of analysis filter bank channels may be set by setting the value of a configurable parameter c1. For example, the analysis filter bank 220 may be configured to have 32 or 24 analysis filter bank channels. In the embodiment of FIG. 2, the number of analysis filter bank channels may be set according to configuration information ci of a configurator 208. After transforming the preprocessed audio signal as2 into the frequency domain, the analysis filter bank 220 feeds the frequency-domain preprocessed audio signal as3 into the subband generator 230.

The subband generator 230 is adapted to create additional subband signals for the frequency-domain audio signal as3. Moreover, the subband generator 230 is adapted to modify the preprocessed frequency-domain audio signal as3 to obtain a modified frequency-domain audio signal as4 which comprises the subband signals of the preprocessed frequency-domain audio signal as3 and the created additional subband signals created by the subband generator 230. The number of additional subband signals that are generated by the subband generator 230 is configurable. In an embodiment, the subband generator is a Spectral Band Replicator (SBR). The subband generator 230 then feeds the modified frequency-domain preprocessed audio signal as4 into the synthesis filter bank.

The synthesis filter bank 240 is adapted to transform the modified frequency-domain preprocessed audio signal as4 from a frequency domain into a time domain to obtain a time-domain processed audio signal as5. The synthesis filter bank 240 has a configurable number of synthesis filter bank channels (synthesis filter bank bands). The number of synthesis filter bank channels is configurable. In an embodiment, the number of synthesis filter bank channels may be set by setting the value of a configurable parameter c2. For example, the synthesis filter bank 240 may be configured to have 64 synthesis filter bank channels. In the embodiment of FIG. 2, the configuration information ci of the configurator 208 may set the number of analysis filter bank channels. By transforming the modified frequency-domain preprocessed audio signal as4 into the time domain, the processed audio signal as5 is obtained.

In an embodiment, the number of subband channels of the modified frequency-domain preprocessed audio signal as4 is equal to the number of synthesis filter bank channels. In such an embodiment, the configurator 208 is adapted to configure the number of additional subband channels that are created by the subband generator 230. The configurator 208 may be adapted to configure the number of additional subband channels that are created by the subband generator 230 such that the number of synthesis filter bank channels c2, configured by the configurator 208, is equal to the number of subband channels of the preprocessed frequency-domain audio signal as3 plus the number of additional subband signals created by the subband generator 230. By this, the number of synthesis filter bank channels is equal to the number of subband signals of the modified preprocessed frequency-domain audio signal as4.

Assuming that the audio signal as1 has a sampling rate sr1, and assuming that the analysis filter bank 220 has c1 analysis filter bank channels and that the synthesis filter bank 240 has c2 synthesis filter bank channels, the processed audio signal as5 has a sampling rate sr5:

$$sr5=(c2/c1)\cdot sr1.$$

c2/c1 determines the upsampling factor u:

$$u=c2/c1.$$

In the embodiment of FIG. 2, the upsampling factor u can be set to a number that is not an integer value. For example, the upsampling factor u may be set to the value 8/3, by setting the number of analysis filter bank channels: c1=24 and by setting the number of synthesis filter bank channels: c2=64, such that:

$$u=8/3=64/24.$$

Assuming that the subband generator 230 is a Spectral Band Replicator, a Spectral Band Replicator according to an embodiment is capable to generate an arbitrary number of additional subbands from the original subbands, wherein the ratio of the number of generated additional subbands to the number of already available subbands does not have to be an integer. For example, a Spectral Band Replicator according to an embodiment may conduct the following steps:

In a first step, the Spectral Band Replicator replicates the number of subband signals by generating a number of additional subbands, wherein the number of generated additional subbands may be an integer multiple of the number of the already available subbands. For example, 24 (or, for example, 48) additional subband signals may be generated from 24 original subband signals of an audio signal (e.g. the total number of subband signals may be doubled or tripled).

In a second step, assuming that the desired number of subband signals is c12 and the number of actual available subband signals is c11, three different situations can be distinguished:

If c11 is equal to c12, then the number c11 of available subband signals is equal to the number c12 of subband signals needed. No subband adjustment is necessitated.

If c12 is smaller than c11, then the number c11 of available subband signals is greater than the number c12 of subband signals needed. According to an embodiment, the highest frequency subband signals might be deleted. For example, if 64 subband signals are available and if only 61 subband signals are needed, the three subband signals with the highest frequency might be discarded.

If c12 is greater than c11, then the number c11 of available subband signals is smaller than the number c12 of subband signals needed.

According to an embodiment, additional subband signals might be generated by adding zero signals as additional subband signals, i.e. signals where the amplitude values of each subband sample are equal to zero. According to another embodiment, additional subband signals might be generated by adding pseudorandom subband signals as additional subband signals, i.e. subband signals where the values of each subband sample comprise pseudorandom data. In another embodiment, additional subband signals might be generated by copying the sample values of the highest subband signal, or the highest suband signals, and to use them as sample values of the additional subband signals (copied subband signals).

In a Spectral Band Replicator according to an embodiment, available baseband subbands may be copied and employed as highest subbands such that all subbands are filled. The same baseband subband may be copied twice or a plurality of times such that all missing subbands can be filled with values.

Figure 3:
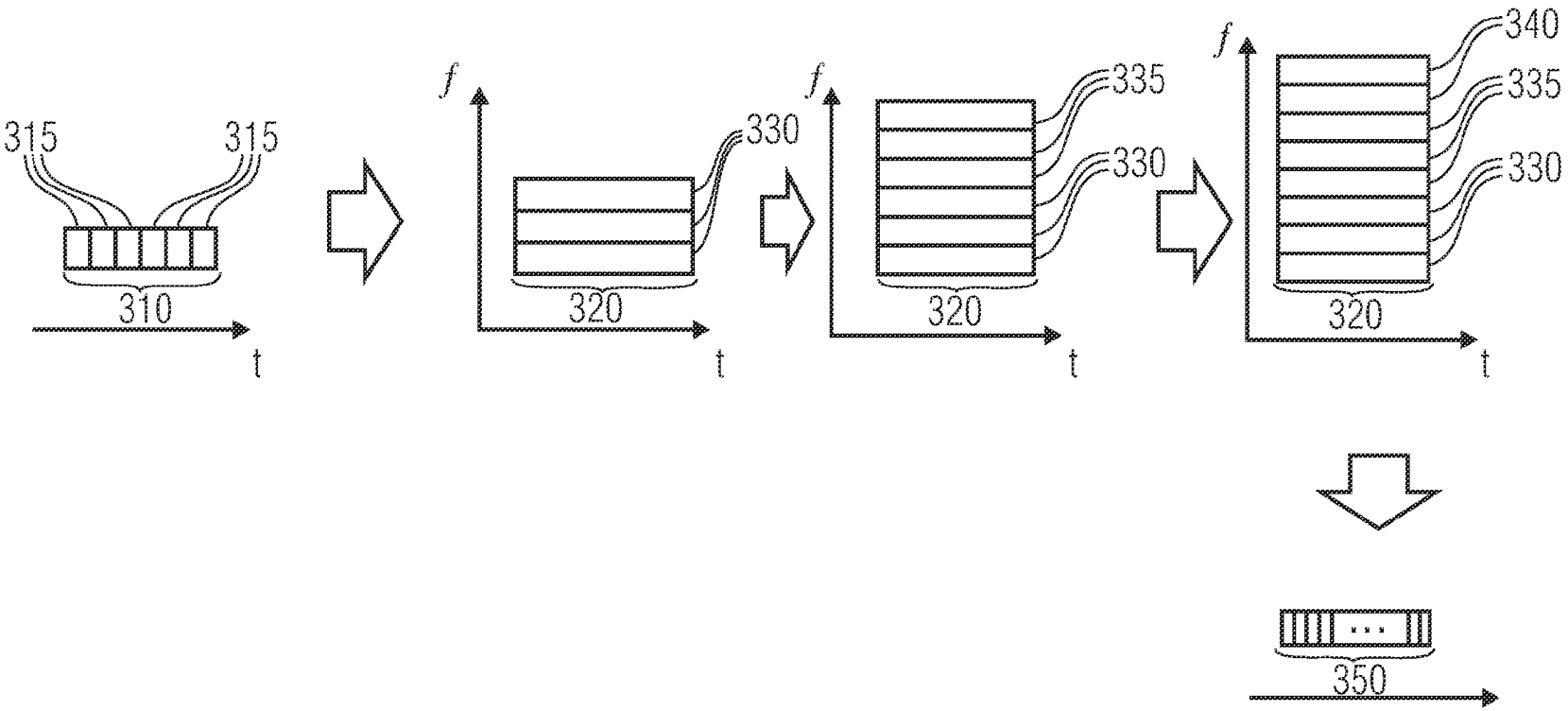
FIG. 3 illustrates an upsampling process conducted by an apparatus according to an embodiment.

FIG. 3 illustrates an upsampling process conducted by an apparatus according to an embodiment. A time domain audio signal 310 and some samples 315 of the audio signal 310 are illustrated. The audio signal is transformed in a frequency domain, e.g. a time-frequency domain to obtain a frequency-domain audio signal 320 comprising three subband signals 330. (In this simplifying example, it is assumed that the analysis filter bank comprises 3 channels.) The subband signals of the frequency domain audio signal 330 may then be replicated to obtain three additional subband signals 335 such that the frequency domain audio signal 320 comprises the original three subband signals 330 and the generated three additional subband signals 335. Then, two further additional subband signals 338 are generated, e.g. zero signals, pseudorandom subband signals or copied subband signals. The frequency domain audio signal is then transformed back into the time domain resulting in a time-domain audio signal 350 having a sampling rate that is 8/3 time the sampling rate of the original time-domain audio signal 310.

Figure 4:
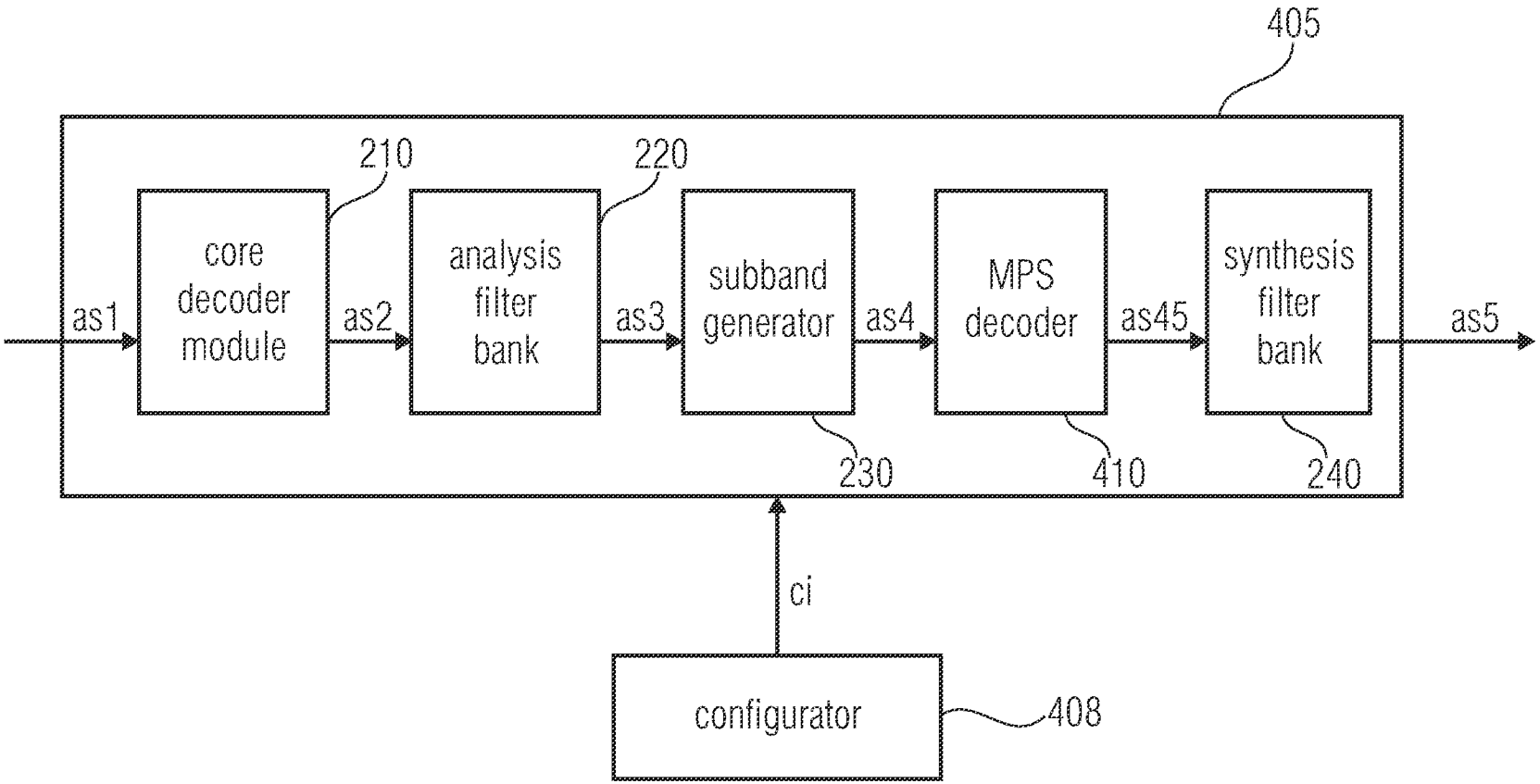
FIG. 4 illustrates an apparatus for processing an audio signal according to a further embodiment.

FIG. 4 illustrates an apparatus according to a further embodiment. The apparatus comprises a signal processor 405 and a configurator 408. The signal processor 405 comprises a core decoder module 210, an analysis filter bank 220, a subband generator 230 and a synthesis filter bank 240, which correspond to the respective units in the embodiment of FIG. 2. The signal processor 405 furthermore comprises an MPEG Surround decoder 410 (MPS decoder) for decoding the preprocessed audio signal to obtain a preprocessed audio signal with stereo or surround channels. The subband generator 230 is adapted to feed the frequency-domain preprocessed audio signal into the MPEG Surround decoder 410 after the additional subband signals for the frequency-domain preprocessed audio signal have been created and added to the frequency-domain preprocessed audio signal.

Figure 5A:
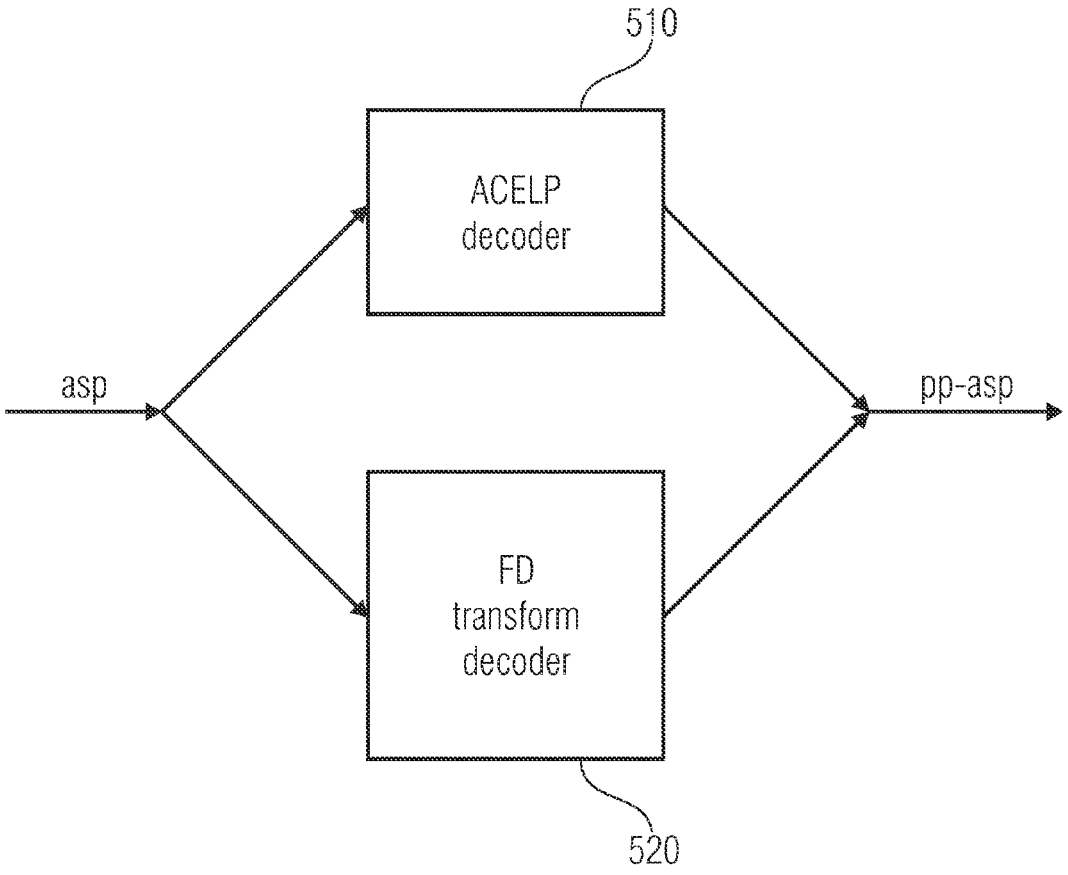
FIG. 5*a* illustrates a core decoder module according to an embodiment.

FIG. 5*a* illustrates a core decoder module according to an embodiment. The core decoder module comprises a first core decoder 510 and a second core decoder 520. The first core decoder 510 is adapted to operate in a time domain and wherein the second core decoder 520 is adapted to operate in a frequency domain. In FIG. 5*a*, the first core decoder 510 is an ACELP decoder and the second core decoder 520 is an FD transform decoder, e.g. an AAC transform decoder. In an alternative embodiment, the second core decoder 520 is a TCX transform decoder. Depending on whether an arriving audio signal portion asp contains speech data or other audio data, the arriving audio signal portion asp is either processed by the ACELP decoder 510 or by the FD transform decoder 520. The output of the core decoder module is a preprocessed portion of the audio signal pp-asp.

Figure 5B:
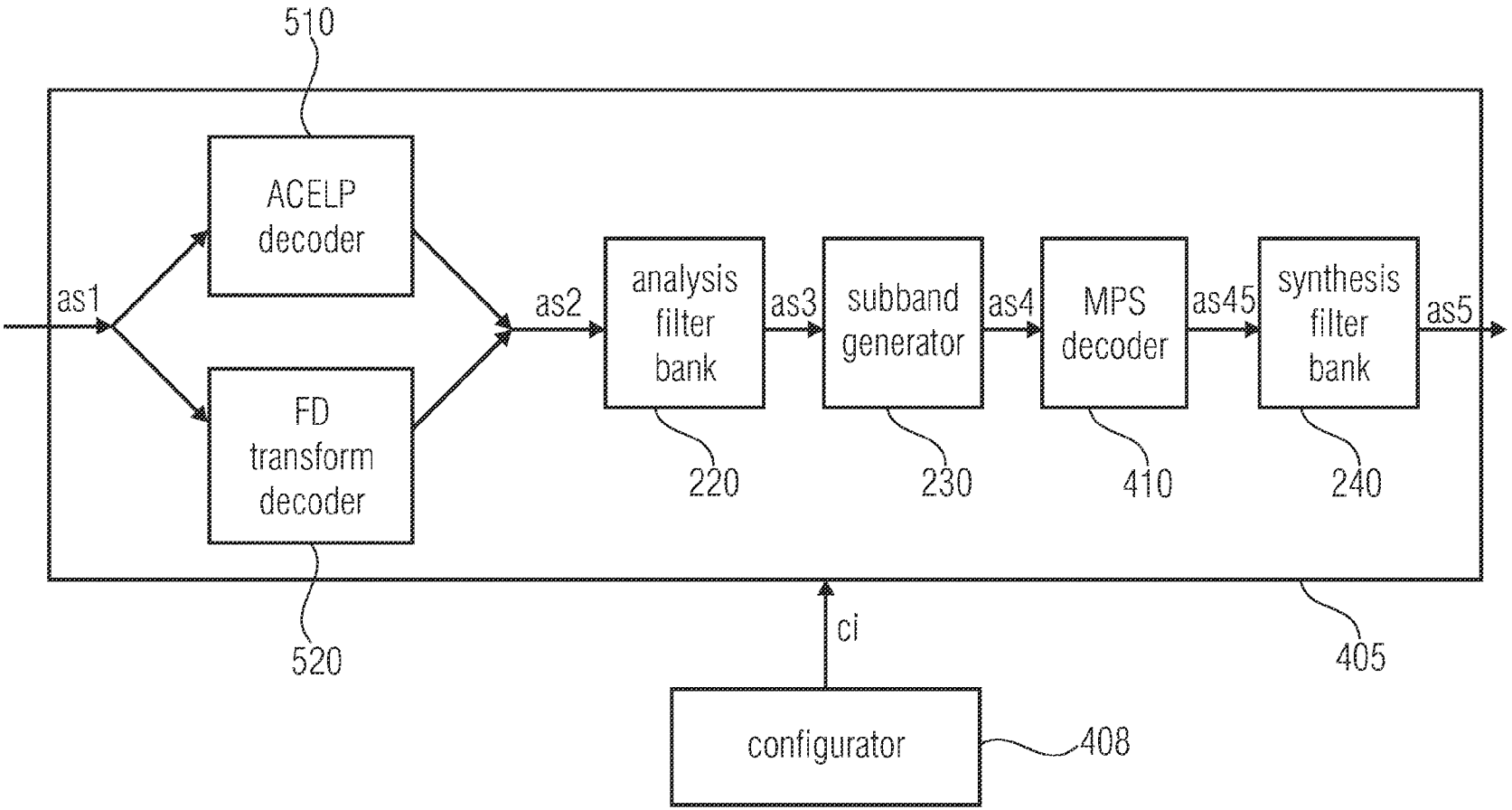
FIG. 5*b* illustrates an apparatus for processing an audio signal according to the embodiment of FIG. 4 with a core decoder module according to FIG. 5*a*.

FIG. 5*b* illustrates an apparatus for processing an audio signal according to the embodiment of FIG. 4 with a core decoder module according to FIG. 5*a*.

Figure 6A:
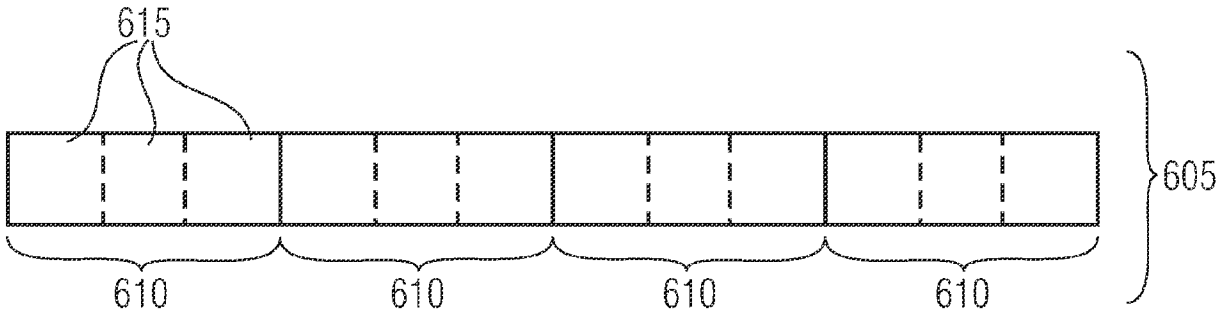
FIG. 6*a* illustrates an ACELP super frame comprising 4 ACELP frames.

In an embodiment, the super-frame size for the ACELP codec is reduced from 1024 to 768 samples. This could be done by combining 4 ACELP frames of size 192 (3 sub-frames of size 64) to one core-coder frame of size 768 (previously: 4 ACELP frames of size 256 were combined to a core-coder frame of size 1024). FIG. 6*a* illustrates an ACELP super frame 605 comprising 4 ACELP frames 610. Each one of the ACELP frames 610 comprises 3 sub-frames 615.

Figure 6B:
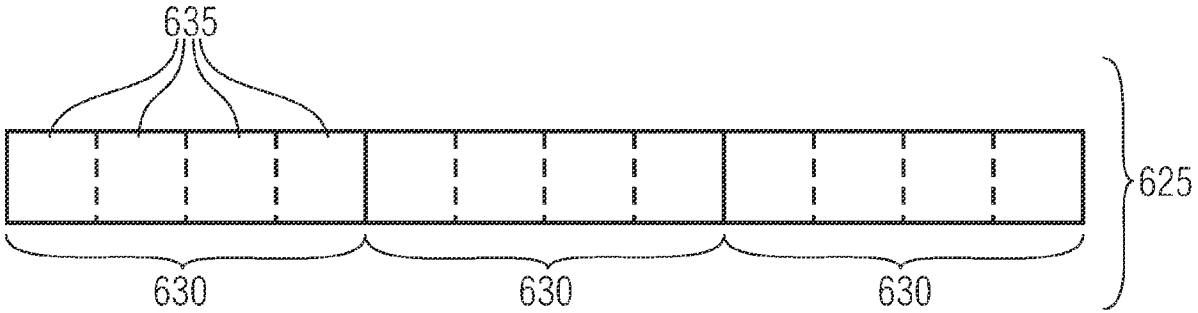
FIG. 6*b* illustrates an ACELP super frame comprising 3 ACELP frames.

Another solution for reaching a core-coder frame size of 768 samples would be for example to combine 3 ACELP frames of size 256 (4 sub-frames of size 64). FIG. 6*b* illustrates an ACELP super frame 625 comprising 3 ACELP frames 630. Each one of the ACELP frames 630 comprises 4 sub-frames 635.

Figure 7A:
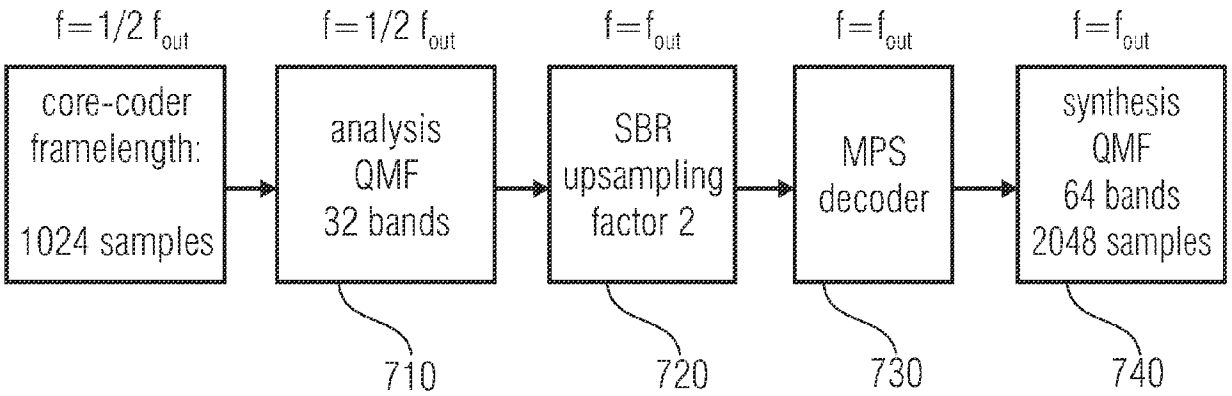
FIG. 7*a* illustrates the default setting of USAC.
Figure 7B:
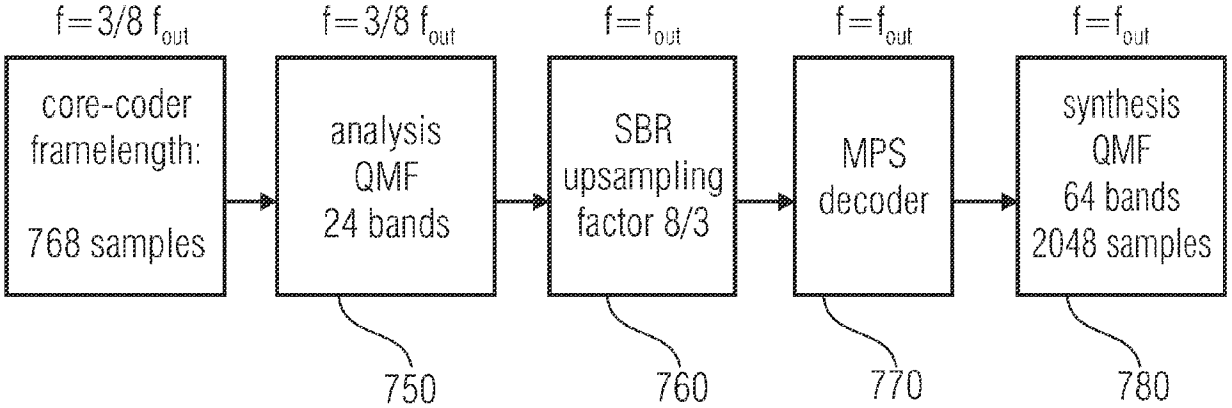
FIG. 7*b* illustrates an extra setting for USAC according to an embodiment.

FIG. 7*b* outlines the proposed additional setting from a decoder perspective and compares it to the traditional USAC setting. FIGS. 7*a* and 7*b* outline the decoder structure as typically used at operating points as 24 kbit/s or 32 kbit/s.

In FIG. 7*a*, illustrating USAC RM9 (USAC reference model 9), default setting, an audio signal frame is inputted a QMF analysis filter bank 710. The QMF analysis filter bank 710 has 32 channels. The QMF analysis filter bank 710 is adapted to transform a time domain audio signal into a frequency domain, wherein the frequency domain audio signal comprises 32 subbands. The frequency domain audio signal is then inputted into an upsampler 720. The upsampler 720 is adapted to upsample the frequency domain audio signal by an upsampling factor 2. Thus, a frequency domain upsampler output signal comprising 64 subbands is generated by the upsampler. The upsampler 720 is an SBR (Spectral Band Replication) upsampler. As already mentioned, Spectral Band Replication is employed to generate higher frequency subbands from lower frequency subbands being inputted into the spectral band replicator.

The upsampled frequency domain audio signal is then fed into an MPEG Surround (MPS) decoder 730. The MPS decoder 730 is adapted to decode a downmixed surround signal to derive frequency domain channels of a surround signal. For example, the MPS decoder 730 may be adapted to generate 2 upmixed frequency domain surround channels of a frequency domain surround signal. In another embodiment, the MPS decoder 730 may be adapted to generate 5 upmixed frequency domain surround channels of a frequency domain surround signal. The channels of the frequency domain surround signal are then fed into the QMF synthesis filter bank 740. The QMF synthesis filter bank 740 is adapted to transform the channels of the frequency domain surround signal into a time domain to obtain time domain channels of the surround signal.

As can be seen, the USAC decoder operates in its default setting as a 2:1 system. The core-codec operates in the granularity of 1024 samples/frame at half of output sampling rate $f_{out}$. The upsampling by a factor of 2 is implicitly performed inside the SBR tool, by combining a 32 band analysis QMF filter bank with a 64 band synthesis QMF bank running at the same rate. The SBR tool outputs frames of size 2048 at $f_{out}$.

FIG. 7*b* illustrates the proposed extra setting for USAC. An QMF analysis filter bank 750, an upsampler 760, an MPS decoder 770 and a synthesis filter bank 780 are illustrated.

In contrast to the default setting, the USAC codec operates in the proposed extra setting as an 8/3 system. The core-coder runs at $3/8^{th}$ of the output sampling rate $f_{out}$. In the same context, the core-coder frame size was scaled down by a factor of ¾. By combination of a 24 band analysis QMF filter bank and a 64 band synthesis filter bank inside the SBR tool, an output sampling rate of $f_{out}$ at a frame length of 2048 samples can be achieved.

This setting allows for a very much increased temporal granularity for both, core-coder and additional tools: Whereas tools such as SBR and MPEG Surround can be operated at a higher sampling rate, the core-coder sampling rate is reduced and instead the frame length shortened. By this way, all components can work in their optimal environment.

In an embodiment, an AAC coder employed as core coder may still determine scalefactors based on an ½ $f_{out}$ sampling rate, even if the AAC coder operates at $3/8^{th}$ of the output sampling rate $f_{out}$.

The table below provides detailed numbers on sampling rates and frame duration for the USAC as used in the USAC reference quality encoder. As can be seen, the frame duration in the proposed new setting can be reduced by nearly 25%, which leads to positive effects for all non-stationary signals, since the spreading of coding noise can also be reduced by the same ratio. This reduction can be achieved without increasing the core-coder sampling frequency, which would have moved the ACELP tool out of its optimized operation range.

| | Sampling rate Core-coder | Sampling rate SBR | Duration per frame |
|---|---|---|---|
| USAC default | 17075 Hz | 34150 Hz | 60 ms |
| Proposed new setting | 16537.5 Hz | 44100 Hz | 46 ms |

The table illustrates sampling rates and frame duration for default and proposed new setting as used in the reference quality encoder at 24 kbit/s.

In the following, the modifications to the USAC decoder necessitated to implement the proposed new setting are described in more detail.

With respect to the transform coder, the shorter frame sizes can be easily achieved by scaling the transform and window sizes by a factor of ¾. Whereas the FD coder in the standard mode operates with transform sizes of 1024 and 128, additional transforms of size 768 and 96 are introduced by the new setting. For the TCX, additional transforms of size of 768, 384 and 192 are needed. Apart from specifying new transform sizes according window coefficients, the transform coder can remain unchanged.

Regarding the ACELP tool, the total frame size needs to be adapted to 768 samples. One way to achieve this goal is to leave the overall structure of the frame is unchanged with 4 ACELP frames of 192 samples fitting within each frame of 768 samples. The adaptation to the reduced frame size is achieved by decreasing the number of subframes per frame from 4 to 3. The ACELP subframe length is unchanged at 64 samples. In order to allow for the reduced number of subframes, the pitch information is encoded using a slightly different scheme: three pitch values are encoded using an absolute-relative-relative scheme using 9, 6 and 6 bits respectively instead of an absolute-relative-absolute-relative scheme using 9, 6, 9 and 6 bits in the standard model. However, other ways of coding the pitch information is possible. The other elements of the ACELP codec, such as the ACELP codebooks as well as the various quantizers (LPC filters, gains, etc.), are left unchanged.

Another way of achieving a total frame size of 768 samples would be to combine three ACELP frames of size 256 for one core-coder frame of size 768.

The functionality of the SBR tool remains unchanged. However, the additional to the 32 band analysis band QMF, a 24 band analysis QMF is needed, to allow for an upsampling of factor 8/3.

In the following, the impact of the proposed extra operating point on the computational complexity is explained. This is at first done on a per codec-tool base and summarized at the end. The complexity is compared against the default low sampling rate mode and against a higher sampling rate mode, as used by the USAC reference quality encoder at higher bitrates which is comparable to the corresponding HE-AACv2 setting for these operating points.

Regarding the Transform coder, the complexity of the transform coder parts scales with sampling rate and transform length. The proposed core-coder sampling rates stay roughly the same. The transform sizes are reduced by a factor of ¾. By this, the computational complexity is reduced by nearly the same factor, assuming a mixed radix approach for the underlying FFTs. Overall, the complexity of the transform based decoder is expected to be slightly reduced compared to the current USAC operating point and reduced by a factor of ¾ compared against a high-sampling operating mode.

With respect to ACELP, the complexity of the ACELP tools mainly assembles of the following operations:

Decoding of the excitation: the complexity of that operation is proportional to the number of subframes per second, which in turn is directly proportional to the core-coder sampling frequency (the subframe size being unchanged at 64 samples). It is therefore nearly the same with the new setting.

LPC filtering and other synthesis operations, including the bass-postfilter: the complexity of this operation is directly proportional to the core-coder sampling frequency and is therefore nearly the same.

Overall, the expected complexity of the ACELP decoder is expected to be unchanged compared to the current USAC operating point and reduced by a factor of ¾ compared against a high-sampling operating mode.

Regarding SBR, the main contributors to the SBR complexity are the QMF filterbanks. The complexity here scales with sampling rate and transform size. In particular the complexity of the analysis filterbank is reduced by roughly a factor of ¾.

With respect to MPEG Surround, the complexity of the MPEG Surround part scales with the sampling rate. The proposed extra operation mode has no direct impact on the complexity of the MPEG Surround tool.

In total, the complexity of the proposed new operating mode was found to be slightly more complex compared to the low sampling rate mode, but below the complexity of the USAC decoder, when run at a higher sampling rate mode (USAC RM9, high SR: 13.4 MOPS, proposed new operating point: 12.8 MOPS).

For the tested operating point, the complexity evaluates as follows:

USAC RM9, operated at 34.15 kHz: approx. 4.6 WMOPS;
USAC RM9, operated at 44.1 kHz: approx. 5.6 WMOPS;
proposed new operating point: approx. 5.0 WMOPS.

Since it is expected that a USAC decoder needs to be capable of handling sampling rates up to 48 kHz in its default configuration, no drawback is expected by this proposed new operating point.

With respect to the memory demand, the proposed extra operating mode necessitates the storage of additional MDCT window prototypes, which sum up in total to below 900 words (32 bit) additional ROM demand. In light of the total decoder ROM demand, which is roughly 25 kWord, this seems to be negligible.

Listening test results show a significant improvement for music and mixed test items, without degrading the quality for speech items. This extra setting is intended as an additional operating mode of the USAC codec.

A listening test according to MUSHRA methodology was conducted to evaluate the performance of the proposed new setting at 24 kbit/s mono. The following conditions were contained in the test: Hidden reference; 3.5 kHz low-pass anchor; USAC WD7 reference quality (WD7@34.15 kHz); USAC WD7 operated at high sampling rate (WD7@44.1 kHz); and USAC WD7 reference quality, proposed new setting (WD7_CE@44.1 kHz).

The test covered the 12 test items from the USAC test set, and the following additional items: si02: castanets; velvet: electronic music; and xylophone: music box.

Figure 8A:
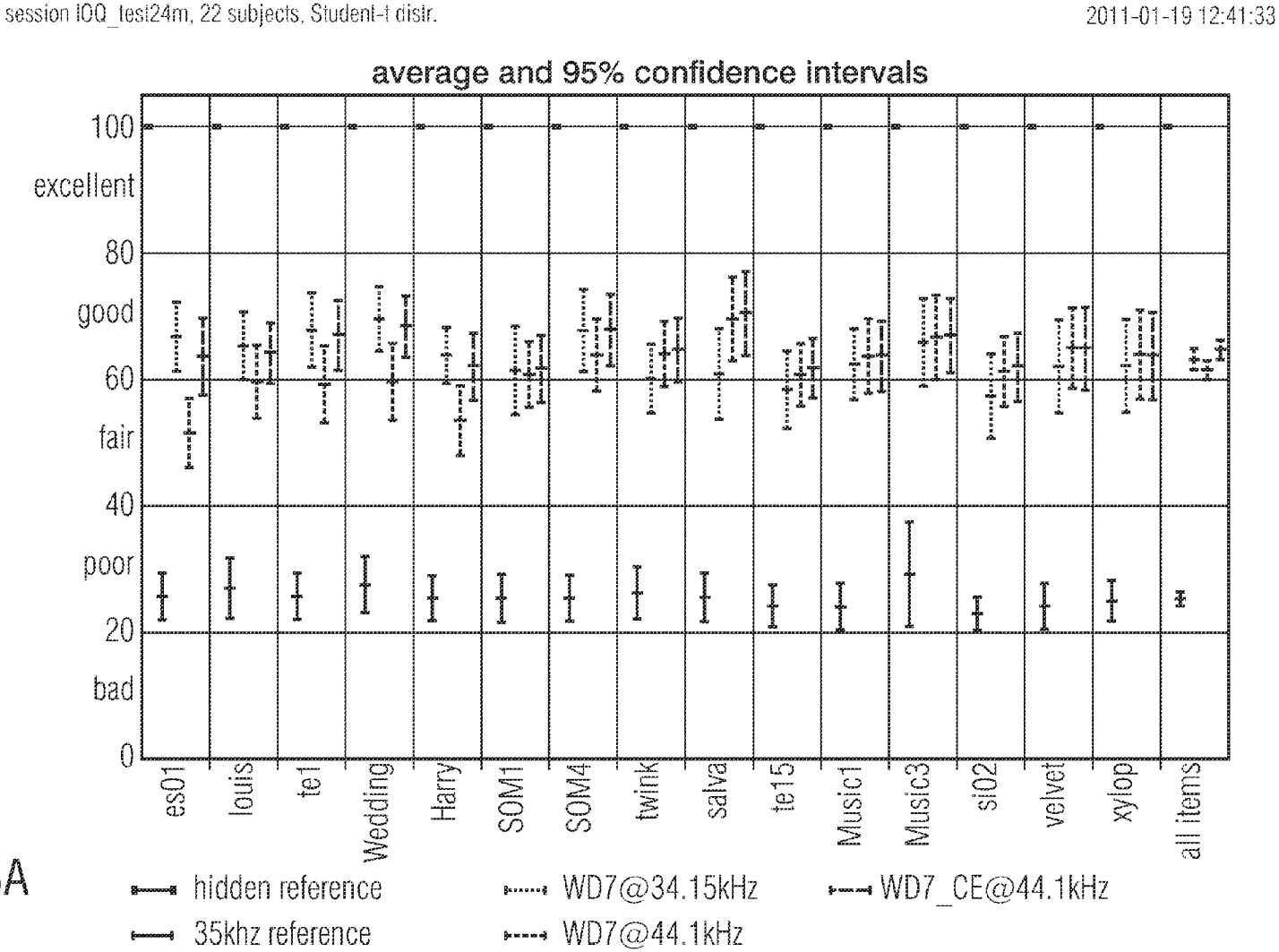
FIG. 8*a*, 8*b* illustrate the results of a listening test according to MUSHRA methodology.
Figure 8B:
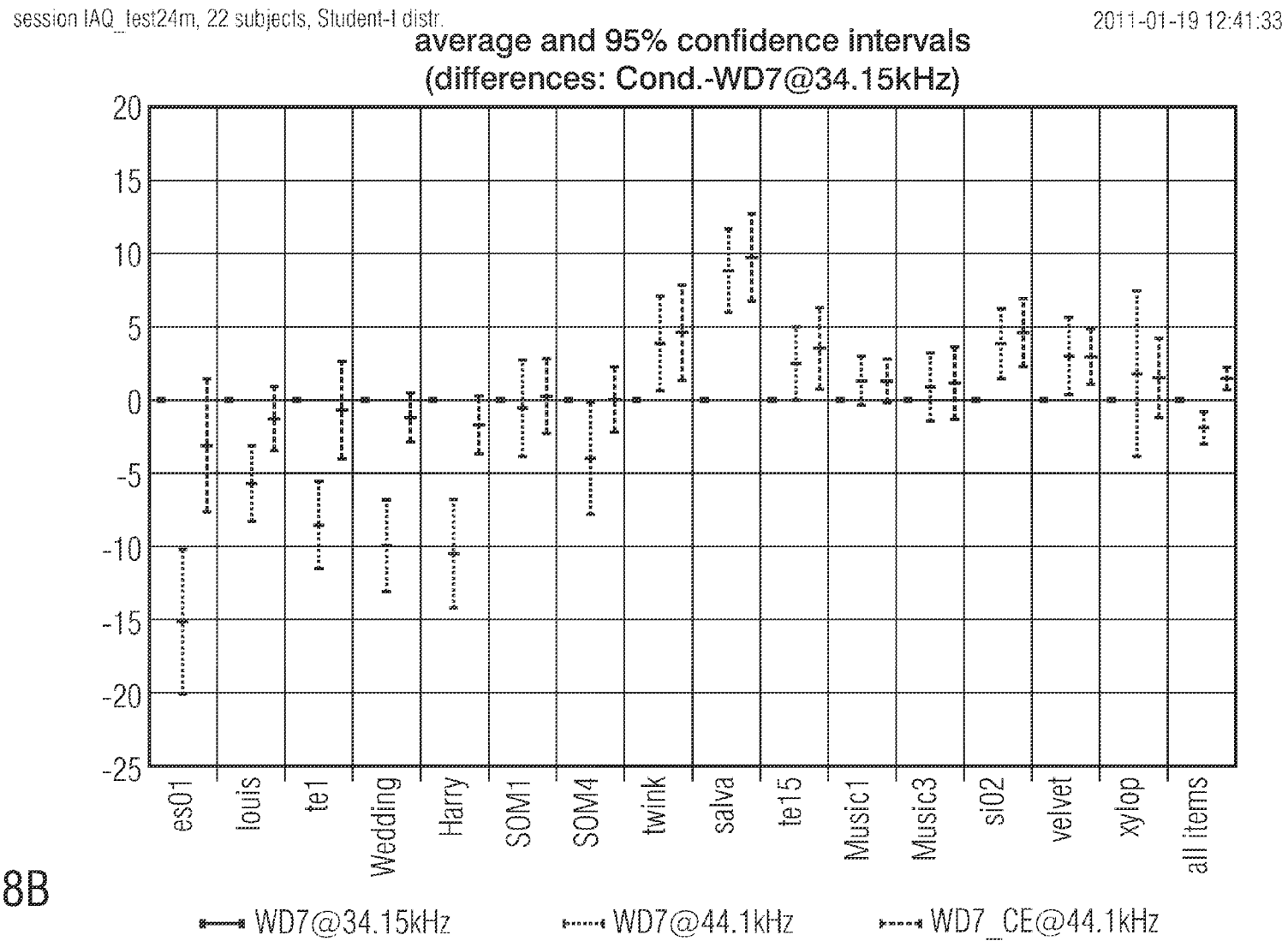

FIGS. 8*a* and 8*b* illustrate the results of the test. 22 subjects participated in the listening test. A Student-t probability distribution was used for the evaluation.

For the evaluation of the average scores (95% level of significance) it can be observed that WD7 operated at a higher sampling rate of 44.1 kHz performs significantly worse than WD7 for two items (es01, HarryPotter). Between WD7 and the WD7 featuring the technology, no significant difference can be observed.

For the evaluation of the differential scores it can be observed that WD7 operated at 44.1 kHz performs worse than WD7 for 6 items (es01, louis_raquin, te1, Wedding-Speech, HarryPotter, SpeechOverMusic_4) and averaged over all items. The items it performs worse for include all pure speech items and two of the mixed speech/music items. Further on can be observed that WD7 operated at 44.1 kHz performs significantly better than WD7 for four items (twinkle, salvation, si02, velvet). All of these items contain significant portions of music signals or are classified as music.

For the technology under test can be observed that it performs better than WD7 for five items (twinkle, salvation, te15, si02, velvet), and additionally when averaged over all items. All of the items it performs better for contain significant portions of music signals or are classified as music. No degradation could be observed.

By the above-described embodiments, a new setting for mid USAC bitrates is provided. This new setting enables the USAC codec to increase its temporal granularity for all relevant tools, such as transform coders, SBR and MPEG Surround, without sacrificing the quality of the ACELP tool. By this, the quality for the mid bitrate range can be improved, in particular for music and mixed signals exhibiting a high temporal structure. Further on, the USAC systems gains at flexibility, since the USAC codec including the ACELP tool can now be used at a wider range of sampling rates, such as 44.1 kHz.

Figure 9:
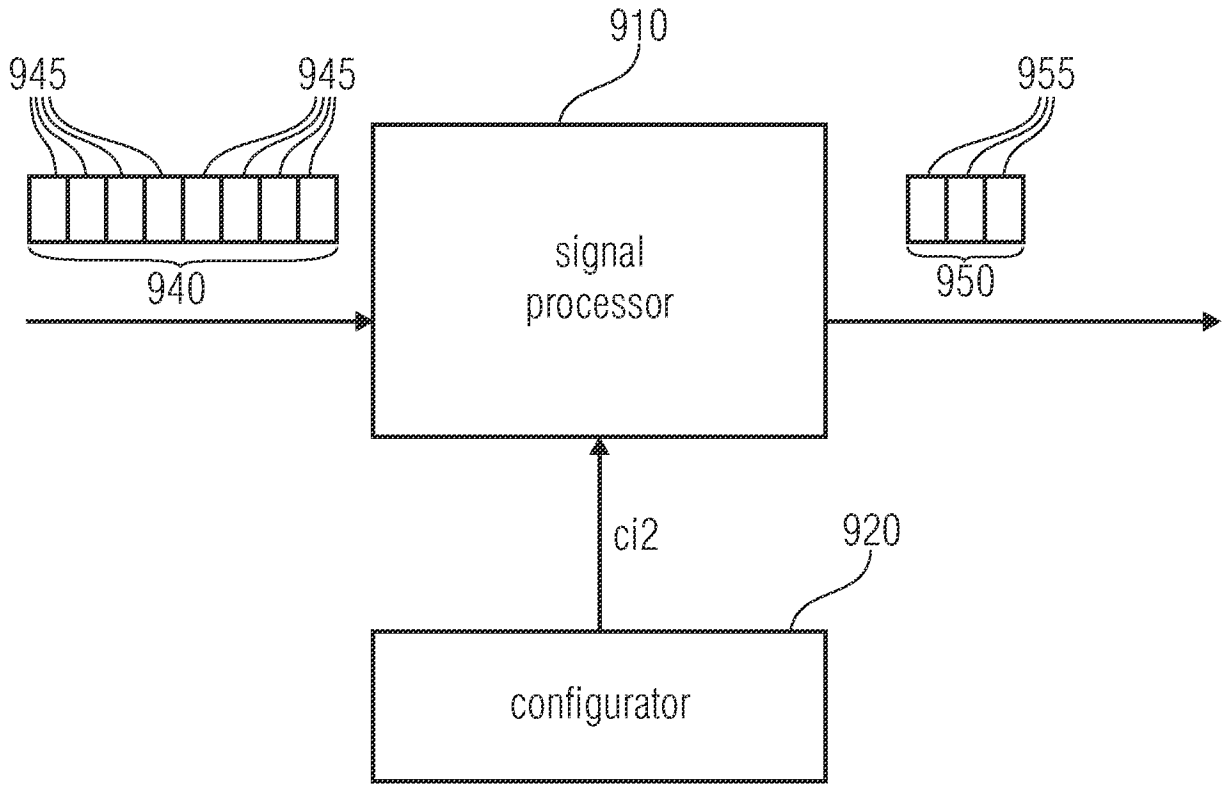
FIG. 9 illustrates an apparatus for processing an audio signal according to an alternative embodiment.

FIG. 9 illustrates an apparatus for processing an audio signal. The apparatus comprises a signal processor 910 and a configurator 920. The signal processor 910 is adapted to receive a first audio signal frame 940 having a first configurable number of samples 945 of the audio signal. Moreover, the signal processor 910 is adapted to downsample the audio signal by a configurable downsampling factor to obtain a processed audio signal. Furthermore, the signal processor is adapted to output a second audio signal frame 950 having a second configurable number of samples 955 of the processed audio signal.

The configurator 920 is adapted to configure the signal processor 910 based on configuration information ci2 such that the configurable downsampling factor is equal to a first downsampling value when a first ratio of the second configurable number of samples to the first configurable number of samples has a first ratio value. Moreover, the configurator 920 is adapted to configure the signal processor 910 such that the configurable downsampling factor is equal to a different second downsampling value, when a different second ratio of the second configurable number of samples to the first configurable number of samples has a different second ratio value. The first or the second ratio value is not an integer value.

An apparatus according to FIG. 9 may for example be employed in the process of encoding.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for processing an audio signal, comprising:

a signal processor that receives a first audio signal frame comprising a first configurable number of samples of the audio signal, upsamples the audio signal by a configurable upsampling factor to acquire a processed audio signal, and outputs a second audio signal frame comprising a second configurable number of samples of the processed audio signal, so that the first configurable number of samples is different from the second configurable number of samples; and a configurator that configures the signal processor, wherein the configurator configures the signal processor based on configuration information such that the configurable upsampling factor is equal to a first upsampling value when a first ratio of the second configurable number of samples to the first configurable number of samples comprises a first ratio value, and wherein the configurator configures the signal processor such that the configurable upsampling factor is equal to a different second upsampling value, the different second upsampling value being different from the first upsampling value, when a different second ratio of the second configurable number of samples to the first configurable number of samples comprises a different second ratio value, and wherein the first or the second ratio value is not an integer value;

wherein the signal processor comprises:

a core decoder module configured to decode the audio signal to obtain a first preprocessed audio signal, an analysis filter bank having a number of analysis filter bank channels, the analysis filter bank being configured to transform the first preprocessed audio signal from a time domain into a frequency domain to obtain a second frequency-domain preprocessed audio signal comprising a plurality of subband signals, a subband generator configured to create and add additional subband signals to the second frequency-domain preprocessed audio signal to obtain a third frequency-domain preprocessed audio signal, wherein the subband generator is a spectral band replicator configured to replicate subband signals of the second frequency-domain preprocessed audio signal to create the additional subband signals for the second frequency-domain preprocessed audio signal to obtain the third frequency-domain preprocessed audio signal, and a synthesis filter bank having a number of synthesis filter bank channels that transform the third frequency-domain preprocessed audio signal from the frequency domain into the time domain to obtain the processed audio signal, wherein the configurator configures the signal processor by configuring the number of synthesis filter bank channels or the number of analysis filter bank channels such that the configurable upsampling factor is equal to a third ratio of the number of synthesis filter bank channels to the number of analysis filter bank channels, and wherein at least one of the signal processor and the configurator comprises a hardware implementation.

2. The apparatus according to claim 1, wherein the configurator configures the signal processor such that the different second upsampling value is greater than the first upsampling value, when the second ratio of the second configurable number of samples to the first configurable number of samples is greater than the first ratio of the second configurable number of samples to the first configurable number of samples.

3. The apparatus according to claim 1, wherein the configurator configures the signal processor such that the configurable upsampling factor is equal to the first ratio value when the first ratio of the second configurable number of samples to the first configurable number of samples comprises the first ratio value, and wherein the configurator configures the signal processor such that the configurable upsampling factor is equal to the different second ratio value when the second ratio of the second configurable number of samples to the first configurable number of samples comprises the different second ratio value.

4. The apparatus according to claim 1, wherein the configurator configures the signal processor such that the configurable upsampling factor is equal to 2 when the first ratio comprises the first ratio value, and wherein the configurator configures the signal processor such that the configurable upsampling factor is equal to 8/3 when the second ratio comprises the different second ratio value.

5. The apparatus according to claim 1, wherein the configurator configures the signal processor such that the first configurable number of samples is equal to 1024 and the second configurable number of samples is equal to 2048 when the first ratio comprises the first ratio value, and wherein the configurator configures the signal processor such that that the first configurable number of samples is equal to 768 and the second configurable number of samples is equal to 2048 when the second ratio comprises the different second ratio value.

6. The apparatus according to claim 1, wherein the core decoder module comprises a first core decoder and a second core decoder, wherein the first core decoder operates in a time domain and wherein the second core decoder operates in a frequency domain.

7. The apparatus according to claim 1, wherein the first core decoder is an ACELP decoder and wherein the second core decoder is a FD transform decoder or a TCX transform decoder.

8. The apparatus according to claim 7, wherein the ACELP decoder processes the first audio signal frame, wherein the first audio signal frame comprises 4 ACELP frames, and wherein each one of the ACELP frames comprises 192 audio signal samples, when the first configurable number of samples of the first audio signal frame is equal to 768.

9. The apparatus according to claim 7, wherein the ACELP decoder processes the first audio signal frame, wherein the first audio signal frame comprises 3 ACELP frames, and wherein each one of the ACELP frames comprises 256 audio signal samples, when the first configurable number of samples of the first audio signal frame is equal to 768.

10. The apparatus according to claim 1, wherein configurator configures the signal processor based on the configuration information indicating at least one of the first configurable number of samples of the audio signal or the second configurable number of samples of the processed audio signal.

11. The apparatus according to claim 1, wherein configurator configures the signal processor based on the configuration information, wherein the configuration information indicates the first configurable number of samples of the audio signal and the second configurable number of samples of the processed audio signal, wherein the configuration information is a configuration index.

12. A method for processing an audio signal, comprising:

configuring a configurable upsampling factor, receiving a first audio signal frame comprising a first configurable number of samples of the audio signal, and upsampling the audio signal by the configurable upsampling factor to acquire a processed audio signal, and to output a second audio frame comprising a second configurable number of samples of the processed audio signal, so that the first configurable number of samples is different from the second configurable number of samples; and wherein the configurable upsampling factor is configured based on configuration information such that the configurable upsampling factor is equal to a first upsampling value when a first ratio of the second configurable number of samples to the first configurable number of samples comprises a first ratio value, and wherein the configurable upsampling factor is configured such that the configurable upsampling factor is equal to a different second upsampling value, the different second upsampling value being different from the first upsampling value, when a different second ratio of the second configurable number of samples to the first configurable number of samples comprises a different second ratio value, and wherein the first or the second ratio value is not an integer value;

wherein the upsampling the audio signal by the configurable upsampling factor to obtain a processed audio signal includes:

decoding the audio signal by a core decoder module to obtain a first preprocessed audio signal, transforming the first preprocessed audio signal by an analysis filter bank having a number of analysis filter bank channels from a time domain into a frequency domain to obtain a second frequency-domain preprocessed audio signal comprising a plurality of subband signals, creating and adding additional subband signals to the second frequency-domain preprocessed audio signal by a subband generator by replicating subband signals of the second frequency-domain preprocessed audio signal for creating the additional subband signals for the second frequency-domain preprocessed audio signal to obtain the third frequency-domain preprocessed audio signal, and transforming the third frequency-domain preprocessed audio signal from the frequency domain into the time domain by a synthesis filter bank having a number of synthesis filter bank channels to obtain the processed audio signal, wherein the configuration information is configured by configuring the number of synthesis filter bank channels or the number of analysis filter bank channels such that the configurable upsampling factor is equal to a third ratio of the number of synthesis filter bank channels to the number of analysis filter bank channels, and wherein the method is performed using a hardware implementation.

13. An apparatus for processing an audio signal, comprising:

a signal processor that receives a first audio signal frame comprising a first configurable number of samples of the audio signal, downsamples the audio signal by a configurable downsampling factor to acquire a processed audio signal, and outputs a second audio frame comprising a second configurable number of samples of the processed audio signal, so that the first configurable number of samples is different from the second configurable number of samples; and a configurator that configures the signal processor, wherein the configurator configures the signal processor based on configuration information such that the configurable downsampling factor is equal to a first downsampling value when a first ratio of the second configurable number of samples to the first configurable number of samples comprises a first ratio value, and wherein the configurator configures the signal processor such that the configurable downsampling factor is equal to a different second downsampling value, the different second downsampling value being different from the first downsampling value, when a different second ratio of the second configurable number of samples to the first configurable number of samples comprises a different second ratio value, and wherein the first or the second ratio value is not an integer value;

wherein the signal processor comprises:

a core decoder module configured to decode the audio signal to obtain a first preprocessed audio signal, an analysis filter bank having a number of analysis filter bank channels that transform the first preprocessed audio signal from a time domain into a frequency domain to obtain a second frequency-domain preprocessed audio signal comprising a plurality of subband signals, wherein the signal processor is configured to delete a plurality of highest subband signals of the second frequency-domain preprocessed audio signal to obtain a third frequency-domain preprocessed audio signal, and a synthesis filter bank having a number of synthesis filter bank channels that transform the third frequency-domain preprocessed audio signal from the frequency domain into the time domain to obtain the processed audio signal, wherein the configurator configures the signal processor by configuring the number of synthesis filter bank channels or the number of analysis filter bank channels such that the configurable downsampling factor is equal to a third ratio of the number of synthesis filter bank channels to the number of analysis filter bank channels, and wherein at least one of the signal processor and the configurator comprises a hardware implementation.

14. The apparatus according to claim 13, wherein the configurator configures the signal processor such that the first downsampling value is smaller than the different second downsampling value, when the first ratio of the second configurable number of samples to the first configurable number of samples is smaller than the second ratio of the second configurable number of samples to the first configurable number of samples.

15. A method for processing an audio signal, comprising:

configuring a configurable downsampling factor, receiving a first audio signal frame comprising a first configurable number of samples of the audio signal, and downsampling the audio signal by the configurable downsampling factor to acquire a processed audio signal, and to output a second audio frame comprising a second configurable number of samples of the processed audio signal, so that the first configurable number of samples is different from the second configurable number of samples; and wherein the configurable downsampling factor is configured based on configuration information such that the configurable downsampling factor is equal to a first downsampling value when a first ratio of the second configurable number of samples to the first configurable number of samples comprises a first ratio value, and wherein the configurable downsampling factor is configured such that the configurable downsampling factor is equal to a different second downsampling value, the different second downsampling value being different from the first downsampling value, when a different second ratio of the second configurable number of samples to the first configurable number of samples comprises a different second ratio value, and wherein the first or the second ratio value is not an integer value;

wherein downsampling the audio signal by the configurable downsampling factor to obtain a processed audio signal includes:

decoding the audio signal by a core decoder module to obtain a first preprocessed audio signal, transforming the first preprocessed audio signal by an analysis filter bank having a number of analysis filter bank channels from a time domain into a frequency domain to obtain a second frequency-domain preprocessed audio signal comprising a plurality of subband signals, deleting a plurality of highest subband signals of the second frequency-domain preprocessed audio signal to obtain a third frequency-domain preprocessed audio signal, and transforming the third frequency-domain preprocessed audio signal from the frequency domain into the time domain by a synthesis filter bank having a number of synthesis filter bank channels to obtain the processed audio signal, wherein the configuration information is configured by configuring the number of synthesis filter bank channels or the number of analysis filter bank channels such that the configurable downsampling factor is equal to a third ratio of the number of synthesis filter bank channels to the number of analysis filter bank channels, and wherein the method is performed by a hardware implementation.

16. A non-transitory computer readable medium including a computer program for performing, when the computer program is executed by a computer or processor, a method for processing an audio signal, comprising:

configuring a configurable upsampling factor, receiving a first audio signal frame comprising a first configurable number of samples of the audio signal, and upsampling the audio signal by the configurable upsampling factor to acquire a processed audio signal, and to output a second audio frame comprising a second configurable number of samples of the processed audio signal, so that the first configurable number of samples is different from the second configurable number of samples;

wherein the configurable upsampling factor is configured based on configuration information such that the configurable upsampling factor is equal to a first upsampling value when a first ratio of the second configurable number of samples to the first configurable number of samples comprises a first ratio value, and wherein the configurable upsampling factor is configured such that the configurable upsampling factor is equal to a different second upsampling value, the different second upsampling value being different from the first upsampling value, when a different second ratio of the second configurable number of samples to the first configurable number of samples comprises a different second ratio value, and wherein the first or the second ratio value is not an integer value;

wherein upsampling the audio signal by the configurable upsampling factor to obtain a processed audio signal includes:

decoding the audio signal by a core decoder module to obtain a first preprocessed audio signal, transforming the first preprocessed audio signal by an analysis filter bank having a number of analysis filter bank channels from a time domain into a frequency domain to obtain a second frequency-domain preprocessed audio signal comprising a plurality of subband signals, creating and adding additional subband signals to the second frequency-domain preprocessed audio signal by a subband generator by replicating subband signals of the second frequency-domain preprocessed audio signal for creating the additional subband signals for the second frequency-domain preprocessed audio signal to obtain the third frequency-domain preprocessed audio signal, and transforming the third frequency-domain preprocessed audio signal from the frequency domain into the time domain by a synthesis filter bank having a number of synthesis filter bank channels to obtain the processed audio signal, and wherein the configuration information is configured by configuring the number of synthesis filter bank channels or the number of analysis filter bank channels such that the configurable upsampling factor is equal to a third ratio of the number of synthesis filter bank channels to the number of analysis filter bank channels.

17. A non-transitory computer readable medium including a computer program for performing, when the computer program is executed by a computer or processor, a method for processing an audio signal, comprising:

configuring a configurable downsampling factor, receiving a first audio signal frame comprising a first configurable number of samples of the audio signal, and downsampling the audio signal by the configurable downsampling factor to acquire a processed audio signal, and to output a second audio frame comprising a second configurable number of samples of the processed audio signal, so that the first configurable number of samples is different from the second configurable number of samples;

wherein the configurable downsampling factor is configured based on configuration information such that the configurable downsampling factor is equal to a first downsampling value when a first ratio of the second configurable number of samples to the first configurable number of samples comprises a first ratio value, and wherein the configurable downsampling factor is configured such that the configurable downsampling factor is equal to a different second downsampling value, the different second value being different from the first downsampling value, when a different second ratio of the second configurable number of samples to the first configurable number of samples comprises a different second ratio value, and wherein the first or the second ratio value is not an integer value;

wherein downsampling the audio signal by the configurable downsampling factor to obtain a processed audio signal includes:

decoding the audio signal by a core decoder module to obtain a first preprocessed audio signal, transforming the first preprocessed audio signal by an analysis filter bank having a number of analysis filter bank channels from a time domain into a frequency domain to obtain a second frequency-domain preprocessed audio signal comprising a plurality of subband signals, and transforming the third frequency-domain preprocessed audio signal from the frequency domain into the time domain by a synthesis filter bank having a number of synthesis filter bank channels to obtain the processed audio signal, and wherein the configuration information is configured by configuring the number of synthesis filter bank channels or the number of analysis filter bank channels such that the configurable downsampling factor is equal to a third ratio of the number of synthesis filter bank channels to the number of analysis filter bank channels.

* * * * *